US006116293A

United States Patent [19]

Stimpl

[11] Patent Number: 6,116,293

[45] Date of Patent: Sep. 12, 2000

[54] ELECTROMAGNETIC SHED FORMING APPARATUS FOR A JACQUARD MACHINE

[75] Inventor: Johann Stimpl, Kaplanstrasse, Austria

[73] Assignee: WIS Seaming Equipment, Inc., Sandpoint, Id.

[21] Appl. No.: 09/395,713

[22] Filed: Sep. 14, 1999

[51] Int. Cl.[7] ..... D03C 3/20

[52] U.S. Cl. ..... 139/455; 66/221

[58] Field of Search ..... 139/455; 66/221

[56] References Cited

U.S. PATENT DOCUMENTS 4,790,154 12/1988 Lonati ..... 66/221
5,392,820 2/1995 Seiler ..... 139/455
5,813,441 9/1998 Dewispelaere ..... 139/455
5,860,454 1/1999 Mista et al. ..... 139/455

*Primary Examiner*—Andy Falik
*Attorney, Agent, or Firm*—Wells, St. John, Roberts, Gregory & Matkins, P.S.

[57] ABSTRACT

An apparatus for forming sheds for a jacquard machine by a hook (7), which is movably guided between a high position and a low position. A lift (9) for the hook (7) can be selectively coupled with a driver stop (11) of the lift via a control element (14) that is mounted in the frame and that is adjustable transverse to a path of movement for the hook (7) by way of a control (30). The driver stop (11) of the lift (9) can be swivelled from a stop-limited drive position into a rest position outside the path of movement of counter-stop (13) for the hook (7). The control element (14) has cam tracks 21, 22 which swivel the driver stop (11) on the lift, and a holding stop (18) for the hook (7) in the high position.

15 Claims, 7 Drawing Sheets

ELECTROMAGNETIC SHED FORMING APPARATUS FOR A JACQUARD MACHINE

FIELD OF THE INVENTION

This invention relates to an apparatus for forming sheds for a jacquard machine by means of hooks, which are movably guided in a frame between a high position and a low position, and a lifting means for the hooks which can each selectively be coupled with associated driver stops of the lifting means via a control element that is mounted in the frame and is adjustable transverse to the path of movement of the hooks by means of a control means.

DESCRIPTION OF THE PRIOR ART

For forming sheds in jacquard machines, the warp threads forming the shed are moved between a high position and a low position by means of a hook suspension gear which each engages in a pulley block connecting two hooks (EP 0,287,921 A1). Depending on their actuation, these hooks provided in pairs can be coupled with two lifting knives moving in opposite directions, in order to move the respective warp thread from the one into the other shed position by means of the hook suspension gear. For adjusting the hook suspension gear it is also known (EP 0,207,529 A2) to provide not two, but merely one hook per warp thread, which hook can in turn be coupled with one of two lifting knives moving in opposite directions. For this purpose, a control element is associated to each hook, which deflects the hook such that the hook, which in the low position is supported on a bottom board, can be hooked up in one of the two lifting knives or in a holding knife. Independent of whether the hooks are arranged singly or in pairs, these known shedding apparatuses for jacquard machines have the disadvantage of complex constructions, because the hooks must be adjusted by means of corresponding control elements and must be coupled with one of two lifting knives moving in opposite directions.

SUMMARY OF THE INVENTION

It is therefore the object underlying the invention to provide an apparatus for forming sheds for a jacquard machine as described above such that a considerable simplification of the construction and thus an increased functional reliability can be ensured.

This object is solved by the invention in that the driver stops of the lifting means can be swivelled from a stop-limited drive position into a rest position outside the path of movement of the counter-stops of the hooks, and that the control elements on the one hand have a cam track for swivelling the driver stops of the lifting means and on the other hand a holding stop for the hooks in the high position.

Due to the measure of pivotally mounting the driver stops of the lifting means such that these driver stops can selectively be adjusted via the associated control elements, the connection of the hooks with the lifting means can easily be controlled without having to move the hooks themselves transverse to their path of movement between the high position and the low position. When the driver stop for the respective hook to be actuated is in its stop-limited drive position, the associated hook can be moved into the respective other shed position via the lifting means. It must merely be ensured that in the respective shed position the hooks are supported against the tensile load which acts on them via the hook suspension gear. For the low position, this can be achieved in a conventional way, e.g. via a bottom board. In the high position, this is achieved by means of a holding stop of the control elements. Since it is merely between the high position and the low position that the hooks are movably guided in the frame on a straight line, retaining the actuated hook in the high position requires a corresponding control movement of the associated control element transverse to the path of movement of the hooks. By combining the pivotally mounted driver stops of the lifting means with control elements, which on the one hand adjust the driver stops of the lifting means and on the other hand form a holding stop for the hooks in the high position, all control tasks can thus advantageously be solved by one control element each associated to the individual hooks.

Since in the low position of the hook the associated driver stop of the lifting means need merely be swivelled out into the rest position, to prevent the hooks from being driven, the control elements need to have cam tracks for the driver stops merely in the vicinity of this low position, when it is ensured that the driver stops of the lifting means return into the stop-limited drive position outside the cam tracks of the control elements. For this purpose, the driver stops can be mounted such that they can be swivelled out of the stop-limited drive position against a restoring moment. Such restoring moment can be ensured by spring-loading the driver stops. To obtain a higher functional reliability, a forced return of the driver stops into the stop-limited drive position should, however, also be effected in the vicinity of the high position. It is therefore recommended to equip the control elements with a cam track for swivelling the driver stops out of the stop-limited drive position in the vicinity of the low position, and with a cam track for swivelling the driver stops into the drive position in the vicinity of the high position, so that springloading the driver stops becomes superfluous.

There can be different adjusting movements of the control elements, because it is merely important to either provide the holding stop for the hooks in the high position by means of a transverse movement of the control elements, or to swivel the driver stops in particular in the vicinity of the low position. Nevertheless, particularly advantageous constructional conditions can be achieved in that the control elements are mounted on a common guiding axle via an inclined guiding slot and can be retained in a raised end position by means of electromagnets. The adjustment of the control elements along an inclined guiding slot in which engages a fixedly mounted guiding axle involves a combined movement of the control elements on the one hand transverse to and on the other hand in the direction of the path of movement of the hooks, so that the adjusting movement of the control elements can be effected via the hooks or the driver stops of the lifting means. In this case, the electromagnets merely serve to retain the upper end position of the control elements.

It is, however, also possible to rotatably mount the control elements on a common swivel axis and swivel them via the hooks or the driver stops of the lifting means, in order to again ensure a corresponding control movement transverse to the path of movement of the hooks. However, rotatably mounting the control elements on a common swivel axis involves increasing regulating distances with increasing distance from the swivel axis, which can be avoided with a parallel displacement of the control elements. For retaining the swivelled-out end position of the pivotally mounted control elements, electromagnets can again be used.

For a better guidance above all of the control elements mounted on a guiding axle by means of guiding slots it is recommended to additionally guide the control elements in particular with respect to the driver stops. For this purpose, the lifting means can form a lifting frame carrying the pivotally mounted driver stops, where the control elements are adjustably guided in this lifting frame, so that for swivelling the driver stops out into the rest position they cannot evade these driver stops.

BRIEF DESCRIPTION OF THE DRAWING

In the drawing, the subject-matter of the invention is represented by way of example, wherein.

DESCRIPTION OF THE PREFERRED EMBODIMENT

Figure 1:
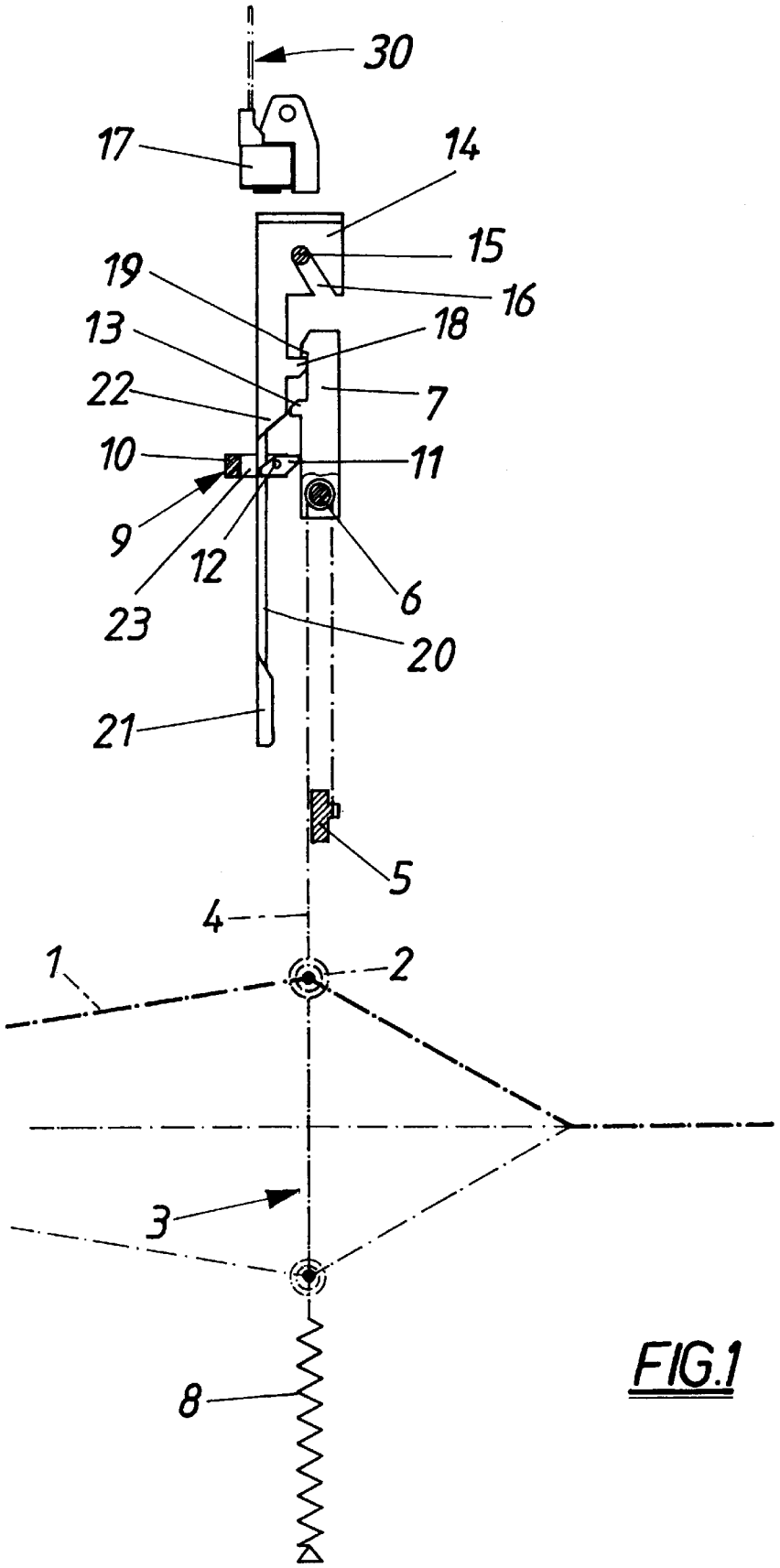
FIGS. 1 to 4 show an inventive apparatus for forming sheds for a jacquard machine in a schematic side view in different working positions.
Figure 2:
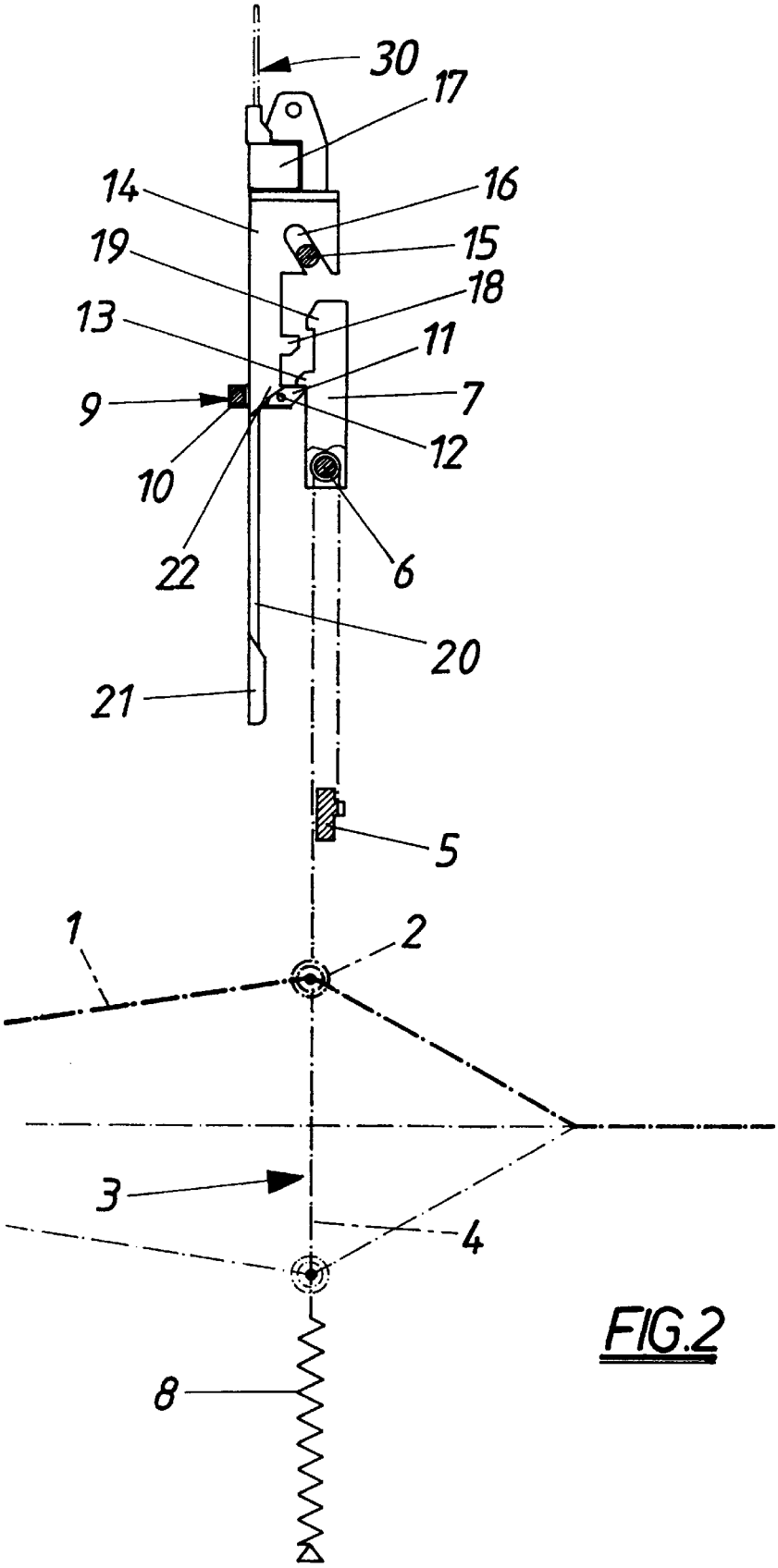

As can be taken from FIGS. 1 to 4, the warp threads 1 forming the shed are guided through lugs 2 of a hook suspension gear 3, which in the embodiment is formed by harness cords 4, but may also consist of heddles. With one end, these harness cords 4 are hooked up into a bottom board 5 and guided about a deflection roller 6 of the respectively associated hook 7. With the other end, the harness cords 4 engage in associated tension springs 8, by means of which the harness cords 4 are kept taut independent of the respective position of the hook 7. Guiding the harness cords 4 over deflection rollers 6 of the hooks 7 involves the advantage that the lugs 2 are moved with the double path of movement of the hooks 7. The stroke of the lifting means 9 provided for moving the hooks 7 can therefore be comparatively small.

Figure 3:
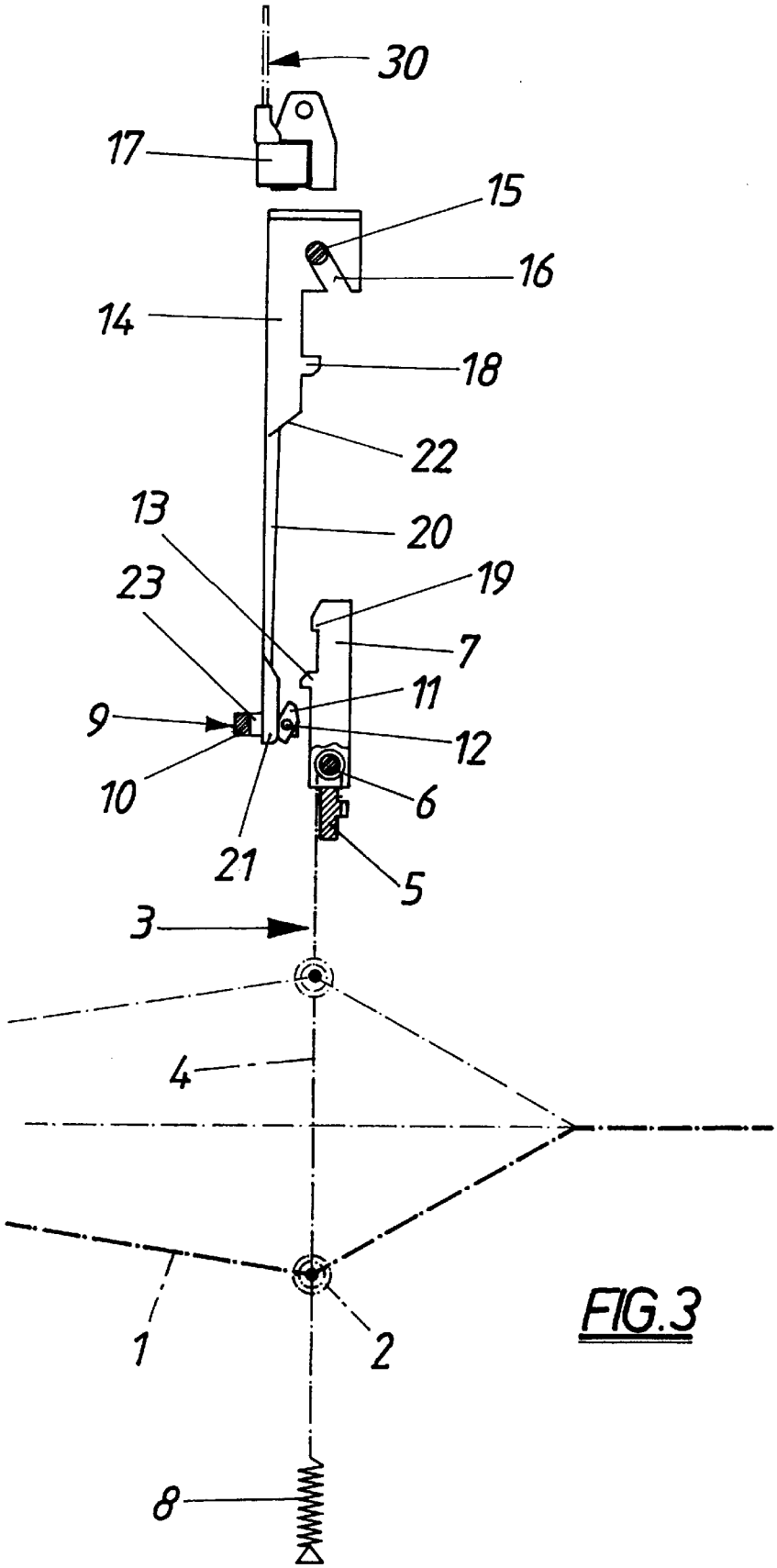

The lifting means 9 for the hooks 7 includes a lifting frame 10 in which for each hook 7 a driver stop 11 is provided, which can be swivelled about a pivot 12 between a stop-limited drive position and a rest position outside the path of movement of the counter-stops 13 of the hooks 7. This swivel movement is effected by means of control elements 14 associated to the individual hooks 7, which control elements are mounted on a common guiding axle 15 via an inclined guiding slot 16 and can be adjusted along their guiding slots 16, as shown in FIGS. 1 to 4. In the upper end position, the control elements 14 can selectively be retained by associated electromagnets 17. The control elements 14 each form a holding stop 18 for the hooks 7 in the upper high position, where the hooks 7 are supported on the associated holding stops 18 by means of a projection 19, as is shown in FIG. 1. The control elements 14 in addition have a supporting arm 20 for a cam track 21, which is used for swivelling the associated driver stop 11. In the position of the control element 14 as shown in FIG. 3, the pivotally mounted driver stop 11 of the lifting frame 10 slides onto the cam track 21 in the vicinity of the low position, so that the driver stop 11 is swivelled from the stop-limited drive position into a rest position outside the path of movement of the counter-stop 13 of the hook 7. For swivelling back the driver stop 11 released by the cam track 21 a dead weight or a restoring spring may be provided. To improve the functional reliability a further cam track 22 is, however, provided at the control element 14 in accordance with the illustrated embodiment, which further cam track ensures a forced swivelling back of the driver stops 11 in the vicinity of the high position, as can be taken from FIG. 2.

As has already been explained, in the position of the control element 14 as shown in FIG. 1, the hook 7 is held in the high position via the holding stop 18 of the control element 14, whereas the lifting frame 10 is moved up and down. When it is desired to move the hook 7 from the high position shown in FIG. 1 into a low position in accordance with FIG. 3 or 4, the control element 14 lifted by means of the lifting frame 10 is retained in its upper end position by the electromagnet 17, which is energized via a control means 30, whereas the lifting frame 10 supporting the hook 7 is moved into the low position. The movement of the control element 14 along the guiding slot 16 effects a release of the projection 19 of the hook 7 by the holding stop 18. To ensure that upon reaching the bottom board 5 the hook 7 is not entrained into the upper high position with the lifting frame 19 again moving upwards, the driver stop 11 must be swivelled out of the path of movement of the counter-stop 13 of the hook into the rest position, which is achieved by the control element 14, which upon dropping off the electromagnet 17 protrudes into the path of the driver stop 11 with the cam track 21 and ensures the swivel movement of said driver stop, as can be taken from FIG. 3.

Figure 4:
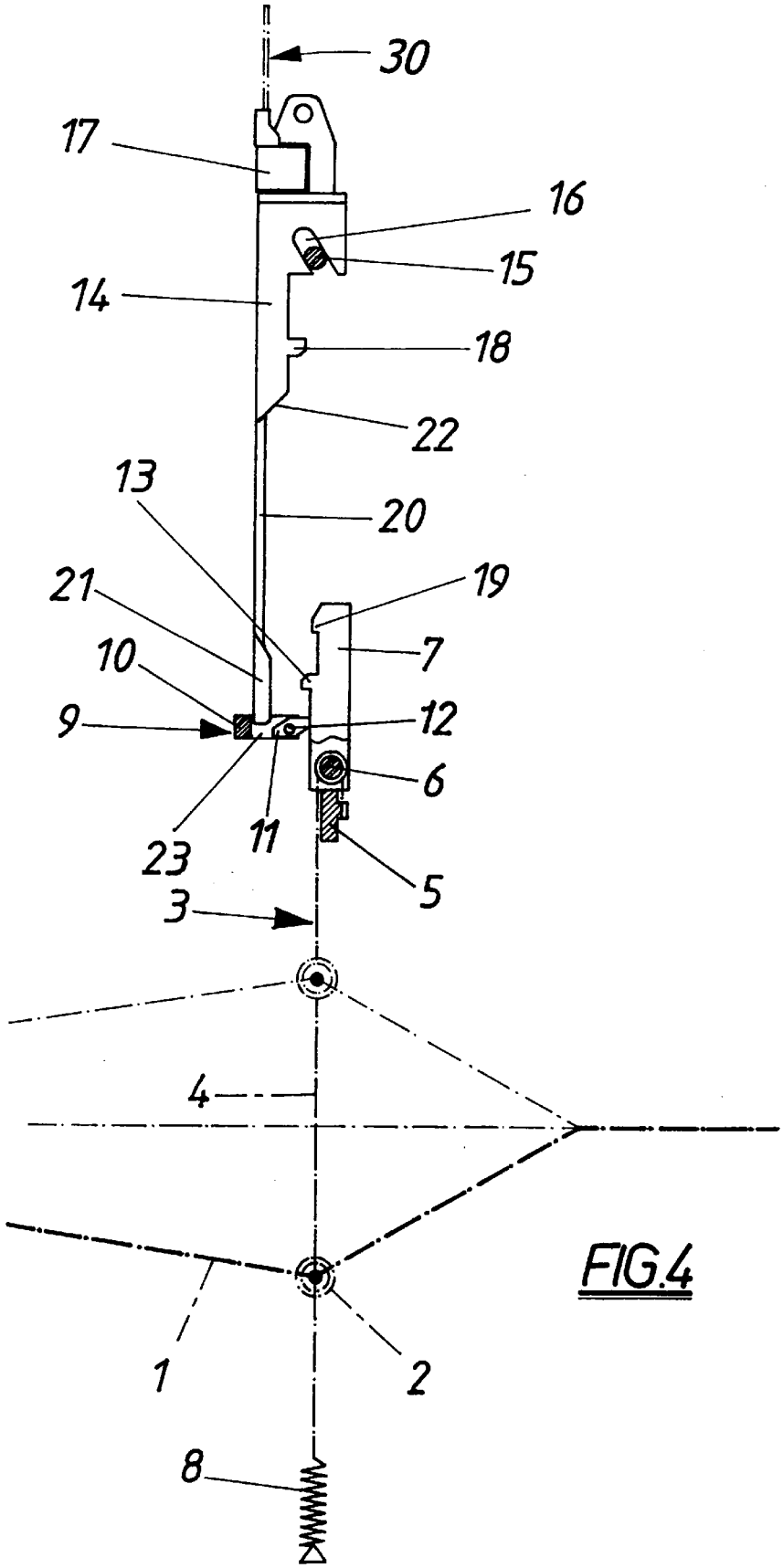

The movement of the hooks 7 from the low position shown in FIG. 3 into a high position shown in FIG. 1 is again effected by briefly energizing the electromagnet 17, which during the downward movement of the lifting frame 10 retains the control element 14 in the upper end position, so that the driver stop 11 is not swivelled out into the rest position by the cam track 21. The driver stop 11 moving past the counter-stop 13 of the hook 7 into the lower reversed position thus entrains the hook 7 during the upward movement of the lifting frame 10, as can be seen in FIG. 4. The hook 7 can therefore be lifted from the low position into the high position via the lifting means 9. Since holding the control element 14 is effected via a slotted guideway 16 on a guiding rod 15, and the supporting arm 20 of the guiding element 14 adjustably engages in a through hole 23 of the lifting frame 10 transverse to the direction of movement of the hooks 7, the holding stops 18 of the guiding elements 14 evade the projections 19 of the hooks 7 lifted by means of the lifting means 9, in order to subsequently engage behind these projections 19. The hooks 7 themselves are merely linearly movably guided in the frame and cannot perform such evading movement.

Figure 7:
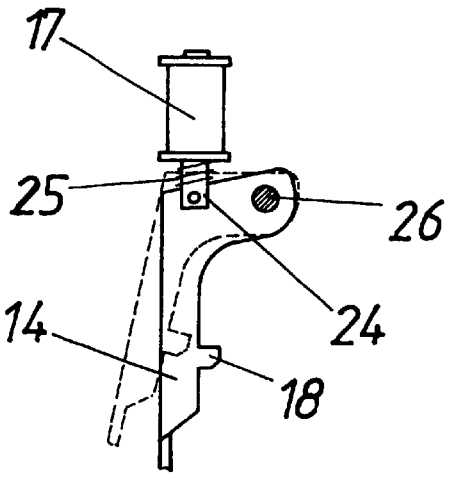
FIGS. 5 to 7 show segments of different actuators for the control elements of an inventive apparatus in a simplified side view.
Figure 6:
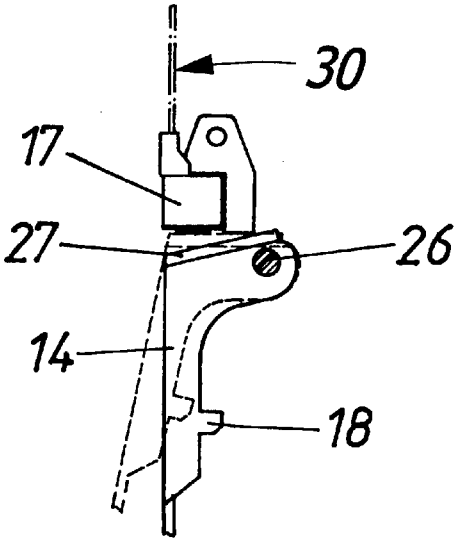
Figure 5:
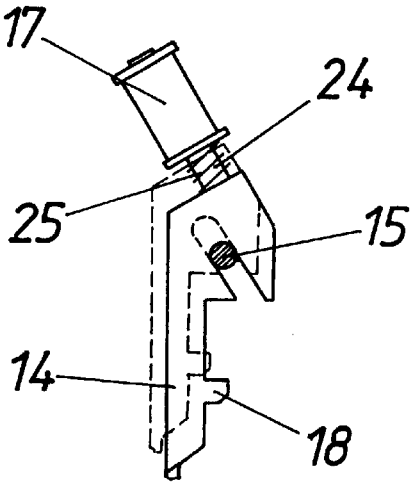

As can be taken from FIGS. 5 to 7, the control elements 14 can be mounted and adjusted in different ways. The embodiment shown in FIG. 5 represents a slotted guideway of the control elements 14 corresponding to FIGS. 1 to 4, but where the electromagnets 17 have lifting armatures 24, which are each connected with a control element 14 and upon energizing the electromagnet 17 are tightened in the direction of the guiding slot 16, as is represented in broken lines. A restoring spring 25 ensures the starting position of the control elements 14 upon energizing the electromagnet 17.

FIGS. 6 and 7 represent control elements 14 which are rotatably mounted about a common swivel axis 26. As shown in FIG. 6, an armature plate 27 associated to the control elements 14 is tightened by the respectively energized electromagnet 17, so that the control element 14 is retained in the swivel position indicated in broken lines. As shown in FIG. 7, the electromagnets 17 are provided with lifting armatures 24 corresponding to FIG. 5, but where the lifting armatures 24 are pivotally mounted at the control elements 14. A restoring spring 25 again moves the control element 14 into the starting position upon energizing the actuated electromagnet.

Figure 8:
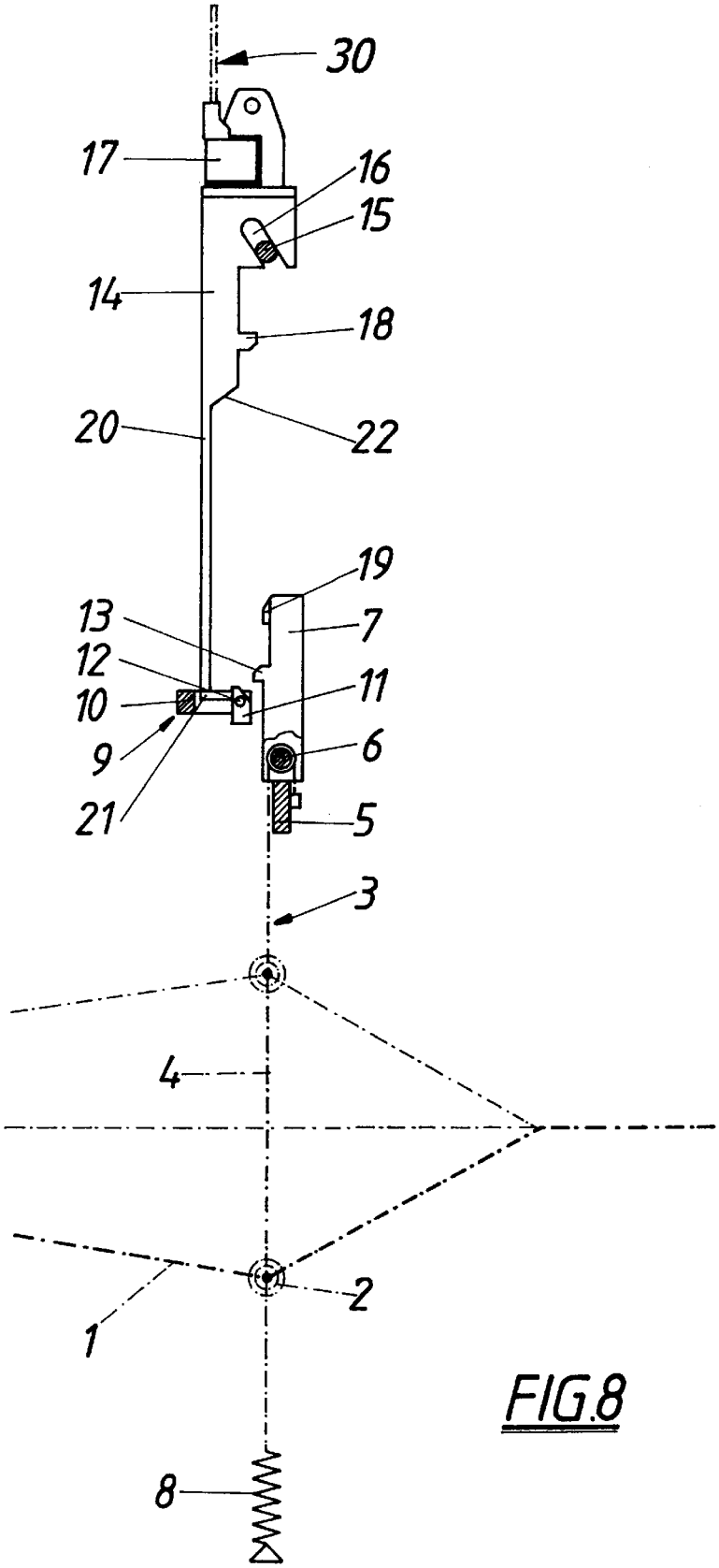
FIGS. 8 and 9 show an embodiment of an inventive apparatus, which is modified with respect to FIGS. 1 to 4, in a schematic side view in different working positions.
Figure 9:
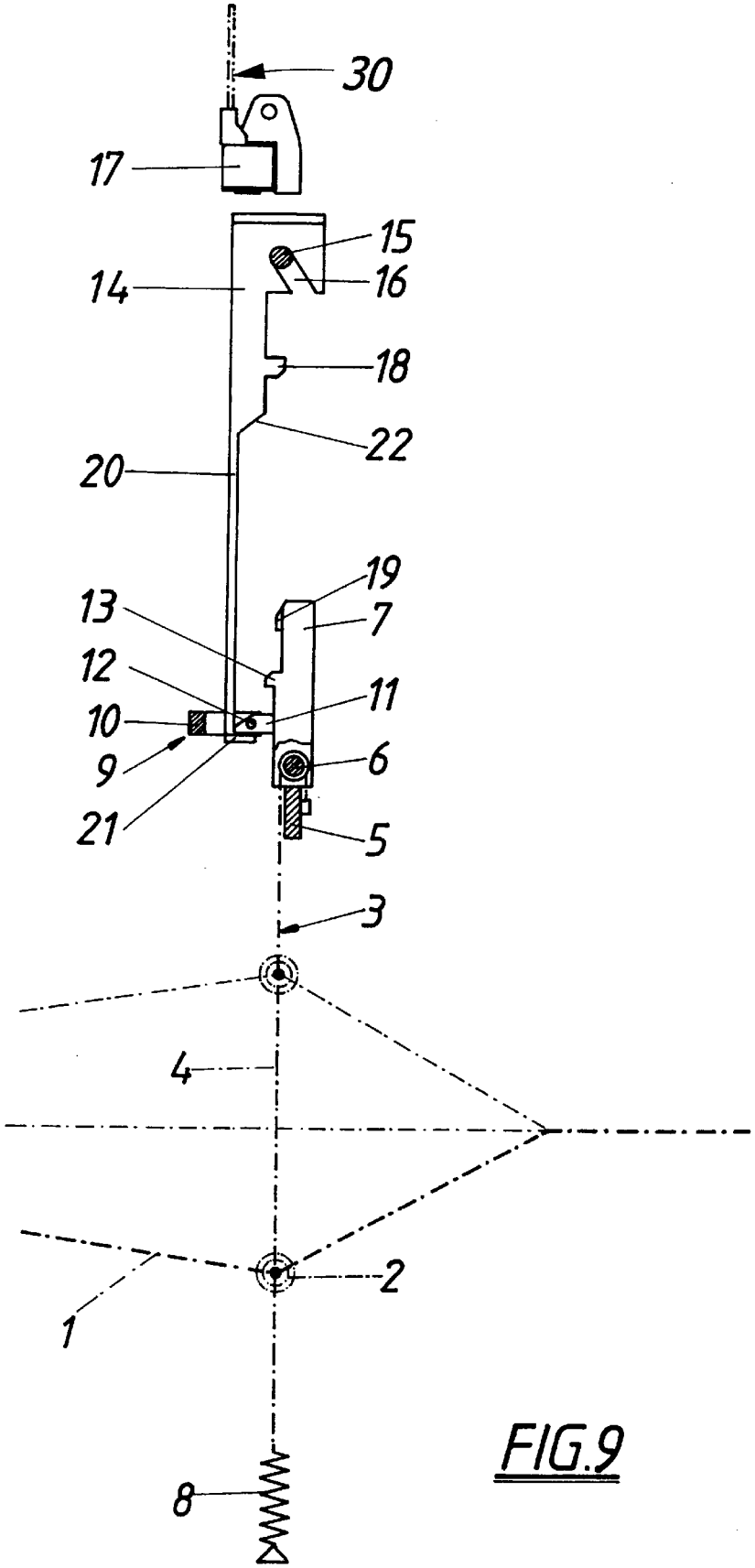

In the embodiment shown in FIGS. 1 to 4, the electromagnet 17 is each energized in order to move the hook from the given shed position into the respective other shed position. This means that the control of the respective shed position must be known in order to eliminate switching errors. As shown in FIGS. 8 and 9, the respective energizing condition of the electromagnet 17 determines the shed position. For this purpose, the cam track 21 of the control element 14 is designed such that in the upper end position of the control element 14 (FIG. 8), which is held by the electromagnet 17, the driver stop 11 is swivelled out into its rest position, which leads to the maintenance of the low position of the hook 7. For lifting the hook 7 into the high position, the electromagnet 17 must be deenergized, as is represented in FIG. 9. Accordingly, the driver stop 11 is swivelled into the drive position, so that the hook 7 is raised by the lifting frame 10, until the projection 19 of the hook 7 is moved past the holding stop 18 of the control element 14, so that during the subsequent downward movement of the lifting frame 10 the hook 7 is retained in the high position by this holding stop 18.

What is claimed is:

1. An apparatus for forming sheds for a jacquard machine, comprising: a hook (7), which is movable between a high position and a low position, and a lifting means (9) for the hook (7) which can each selectively be coupled with a driver stop (11) of the lifting means (9) via a control element (14) that is adjustable transverse to a path of movement of the hook (7) by a control means (30), wherein the driver stop (11) of the lifting means (9) can be swivelled from a stop-limited drive position into a rest position outside a path of movement of a counter-stop (13) on the hook (7), and wherein the control element (14) has cam tracks (21, 22) for swivelling the driver stop (11) of the lifting means (8) and a holding stop (18) for engaging the hook (7) in the high position.

2. The apparatus of claim 1, wherein the driver stop (11) is mounted by a pivot (12) to the lifting means and can be swivelled out of the stop-limited drive position against a restoring moment.

3. The apparatus of claim 1, in which the cam track (21) is positioned to swivel the driver stop (11) out of the stop-limited drive position and to the rest position in the vicinity of the low position and wherein the cam track (22) is positioned to swivel the driver stop (11) into the stop-limited drive position in the vicinity of the high position.

4. The apparatus of claim 3, wherein the control element (14) is mounted on a common guiding axle (15) via an inclined guiding slot (16) formed in the control element; and further comprising an electromagnet (17) positioned to selectively retain the control element (14) in an upper end position.

5. The apparatus of claim 3, wherein the control element (14) is rotatably mounted on a swivel axis (26) and can be retained in a swivelled end position, and further comprising an electromagnet (17) positioned to retain the control element (14) in the swivelled end position.

6. The apparatus of claim 3, wherein the lifting means (9) forms a lifting frame (10) carrying the driver stop (11), and movably guiding the control element (14).

7. The apparatus of claim 2, in which the cam track (21) is positioned to swivel the driver stop (11) out of the stop-limited drive position and to the rest position in the vicinity of the low position and wherein the cam track (22) is positioned to swivel the driver stop (11) into the stop-limited drive position in the vicinity of the high position.

8. The apparatus of claim 2, wherein the control element (14) is mounted on a common guiding axle (15) via an inclined guiding slot (16) formed in the control element; and further comprising an electromagnet (17) positioned to selectively retain the control element (14) in an upper end position.

9. The apparatus of claim 2, wherein the control element (14) is rotatably mounted on a swivel axis (26) and can be retained in a swivelled end position, and further comprising an electromagnet (17) positioned to retain the control element (14) in the swivelled end position.

10. The apparatus of claim 2, wherein the lifting means (9) forms a lifting frame (10) carrying the driver stop (11), and movably guiding the control element (14).

11. The apparatus of claim 10, wherein the lifting means (9) forms a lifting frame (10) carrying the driver stop (11), and movably guiding the control element (14).

12. The apparatus of claim 1, wherein the control element (14) is mounted on a common guiding axle (15) via an inclined guiding slot (16) formed in the control element; and further comprising an electromagnet (17) positioned to selectively retain the control element (14) in an upper end position.

13. The apparatus of claim 12, wherein the lifting means (9) forms a lifting frame (10) carrying the driver stop (11), and movably guiding the control element (14).

14. The apparatus of claim 1, wherein the control element (14) is rotatably mounted on a swivel axis (26) and can be retained in a swivelled end position, and further comprising an electromagnet (17) positioned to retain the control element (14) in the swivelled end position.

15. The apparatus of claim 1, wherein the lifting means (9) forms a lifting frame (10) carrying the driver stop (11), and movably guiding the control element (14).

* * * * *

UNITED STATES PATENT AND TRADEMARK OFFICE

CERTIFICATE OF CORRECTION

PATENT NO. : 6,116,293

DATED : September 12, 2000

INVENTOR(S) : Johann Stimpl

It is certified that error appears in the above-identified patent and that said Letters Patent are hereby corrected as shown below:

On page 1, [54] Title, replace "Electromagnetic Shed Forming Apparatus" with --Apparatus for Forming Sheds for a Jacquard Machine--.

On page 1, [57] Abstract, replace "An apparatus for forming sheds" with --An apparatus is described for forming sheds--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*